US006495207B1

(12) United States Patent
Prociw et al.

(10) Patent No.: US 6,495,207 B1
(45) Date of Patent: Dec. 17, 2002

(54) METHOD OF MANUFACTURING A COMPOSITE WALL

(75) Inventors: Lev Alexander Prociw, Elmira (CA); Michael Dowhan, Milton (CA); Joseph Brand, Mississauga (CA)

(73) Assignee: Pratt & Whitney Canada Corp., Quebec (CA)

( * ) Notice: Subject to any disclaimer, the term of this patent is extended or adjusted under 35 U.S.C. 154(b) by 0 days.

(21) Appl. No.: 10/026,168

(22) Filed: Dec. 21, 2001

(51) Int. Cl.[7] ..... B05D 5/20

(52) U.S. Cl. ..... 427/245; 427/247; 427/250; 427/255.7; 427/258; 427/259; 427/261; 427/287; 427/316; 427/319; 427/322; 427/383.3; 427/398.1; 427/405; 427/422; 427/427

(58) Field of Search ..... 427/245, 247, 427/250, 255.7, 259, 261, 287, 258, 316, 319, 322, 383.3, 393.1, 405, 422, 427

(56) References Cited

U.S. PATENT DOCUMENTS 3,594,109 A 7/1971 Penay
3,918,255 A 11/1975 Holden
4,030,875 A 6/1977 Grondahl et al.
4,838,030 A 6/1989 Cramer
4,838,031 A 6/1989 Cramer
5,184,455 A 2/1993 Ewing et al.
5,499,499 A 3/1996 Ambrogi et al.
5,605,046 A 2/1997 Liang
5,951,791 A 9/1999 Bell et al.
6,079,199 A 6/2000 McCaldon et al.
6,182,451 B1 2/2001 Hadder
6,197,424 B1 3/2001 Morrison et al.
6,245,424 B1 6/2001 Lau et al.

*Primary Examiner*—Bernard Pianalto
(74) *Attorney, Agent, or Firm*—Bachman & LaPointe, P.C.

(57) ABSTRACT

A method of manufacturing a composite wall with an open cell metal foam core layer bonded to an inner cladding layer and an outer cladding layer. The method involves: creating a core substrate of open cell gas permeable foam in a chosen shape; impregnating the open cell foam substrate with metal vapour and depositing a porous layer of metal on exposed internal and external surfaces of the substrate thereby forming the open cell metal foam core through metal vapour deposition; and forming the inner and outer cladding layers upon the metal foam core through spray application of metal or ceramic.

10 Claims, 2 Drawing Sheets

METHOD OF MANUFACTURING A COMPOSITE WALL

TECHNICAL FIELD

The invention relates to a method of manufacturing a combustor for a gas turbine engine having an air permeable open cell metal foam core bounded by perforated thin metal or ceramic walls inwardly and outwardly.

BACKGROUND OF THE ART

The invention includes manufacturing a composite wall having an open cell metal foam core layer bonded to an inner and outer layer of metal or ceramic, that can be used for constructing the walls of a high temperature low cost combustor chamber for a gas turbine engine.

A common prior art annular combustor is constructed of large sections that have thin metal walls that are machined down in thickness from a single forging as for example shown in U.S. Pat. No. 6,079,199 to McCaldon et al. issued Jun. 27, 2000. Large sections of the combustor are machined from a single forging or the entire combustor shell is constructed from several individually machined panels, each from a separate forging and thereafter precisely welded together.

However, this method for creating a combustor shell is less than optimum due to the inherent limitations of fitting, welding and machining large components to the required finished tolerances. In order to economically produce a combustor wall, sections may be left relatively thick in cross section to reduce the amount of machining time required and also to reduce the difficulty involved in machining very thin shells having a large diameter. As a result, therefore, prior art combustors can be very heavy with mechanical strength that far exceeds the requirements of the engine and the requirements of the combustor as a pressure vessel. Joints between panels are left relatively thick in order to permit the drilling of a large number of small cooling holes that are required to develop a cooling protective air film in a down stream combustor section.

The metal structures are expensive, difficult to machine from tough high strength expensive materials, and may still require a coating of a ceramic thermal barrier on the inner surface to protect the metal. The complexity of the surface features and a large number of cooling holes make application of the spray ceramic coating a time consuming and expensive proposition, due to the amount of preparation work in masking over openings to avoid covering the cooling openings or grooves to maintain their function. Although modern fabrication techniques employing computer control have somewhat mitigated manufacturing costs, the modern combustor is still an expensive structure to produce.

The role of the combustor is to serve as a heat shield protecting the walls of the pressure vessel, which surrounds the combustor and contains compressed air from the compressor. Combustion gases are produced from ignition of the fuel and air mixture, and the combustor also serves to physically duct the combustion gases and protect the adjacent portions of the engine from the extreme heat of the combustion gases. The combustor also meters the compressed air flowing into the combustor in a specific proportion creating a fuel/air mixture that allows the formation of a stable flame zone within the combustor. If airflow was not partitioned and metered within the combustor, the flame would be difficult to establish and maintain, thereby leading to engine performance that is extremely unreliable.

However, the combustor in practice is a little more than a gas flow baffle that separates gases of different temperatures. It meters the flow of compressed air into the combustion zone and structurally resists a modest pressure drop across it's surface as air enters cooling holes and metering holes. The load imposed by this pressure differential acting on the combustor walls is relatively low and a very thin walled section could easily support the pressure difference. The greatest stress on the combustor walls results from large temperature gradients generated by the non-homogeneous gas temperatures within the combustor that result in differential thermal stresses, and are dependent on the efficiency of air/fuel mixing. The higher the temperature gradients within the combustor, the higher the thermal stresses that the combustor must resist. The wall thickness in a homogeneous material such as nickel alloy also aggravates the gradient and stresses.

It is an object of the present invention to produce an improved combustor for a gas turbine engine that can be manufactured more cheaply and offers better performance.

It is a further object of the invention to provide a method for manufacturing an improved combustor Further objects of the invention will be apparent from review of the disclosure, drawings and description of the invention below.

DISCLOSURE OF THE INVENTION

The invention provides a method of manufacturing a composite wall for a gas turbine engine combustor having an open cell metal foam core layer bonded to an inner and outer cladding layer of metal or ceramic.

A core substrate of open cell gas permeable foam is created in a selected geometry, for example of molded polyurethane foam rubber. The substrate is easily molded and can be thermally converted to a relatively rigid but brittle carbon structure that may be easily machined. The open cell carbon foam substrate is then impregnated with metal vapour and a porous layer of metal is deposited on exposed internal and external surfaces of the substrate thereby forming the open cell metal foam core through metal vapour deposition. Formation of nickel-aluminum foam structures are described in U.S. Pat. No. 5,951,791 to Bell et al, which is incorporated by reference herein.

Thin inner and outer cladding layers are formed upon the metal foam core through spray application of metal or ceramic cladding materials. Masking of the metal foam core before spraying results in formation of ports or slots for gas flow through the composite wall for cooling, air film formation, filtering or other purposes. The impregnating step may include exposing the substrate to nickel vapour and thereafter coating the nickel metal foam core with aluminium through metal vapour deposition that can further be reacted to form a nickel aluminide metal foam core.

DESCRIPTION OF THE DRAWINGS

In order that the invention may be readily understood, one embodiment of the invention is illustrated by way of example in the accompanying drawings.

Figure 1:
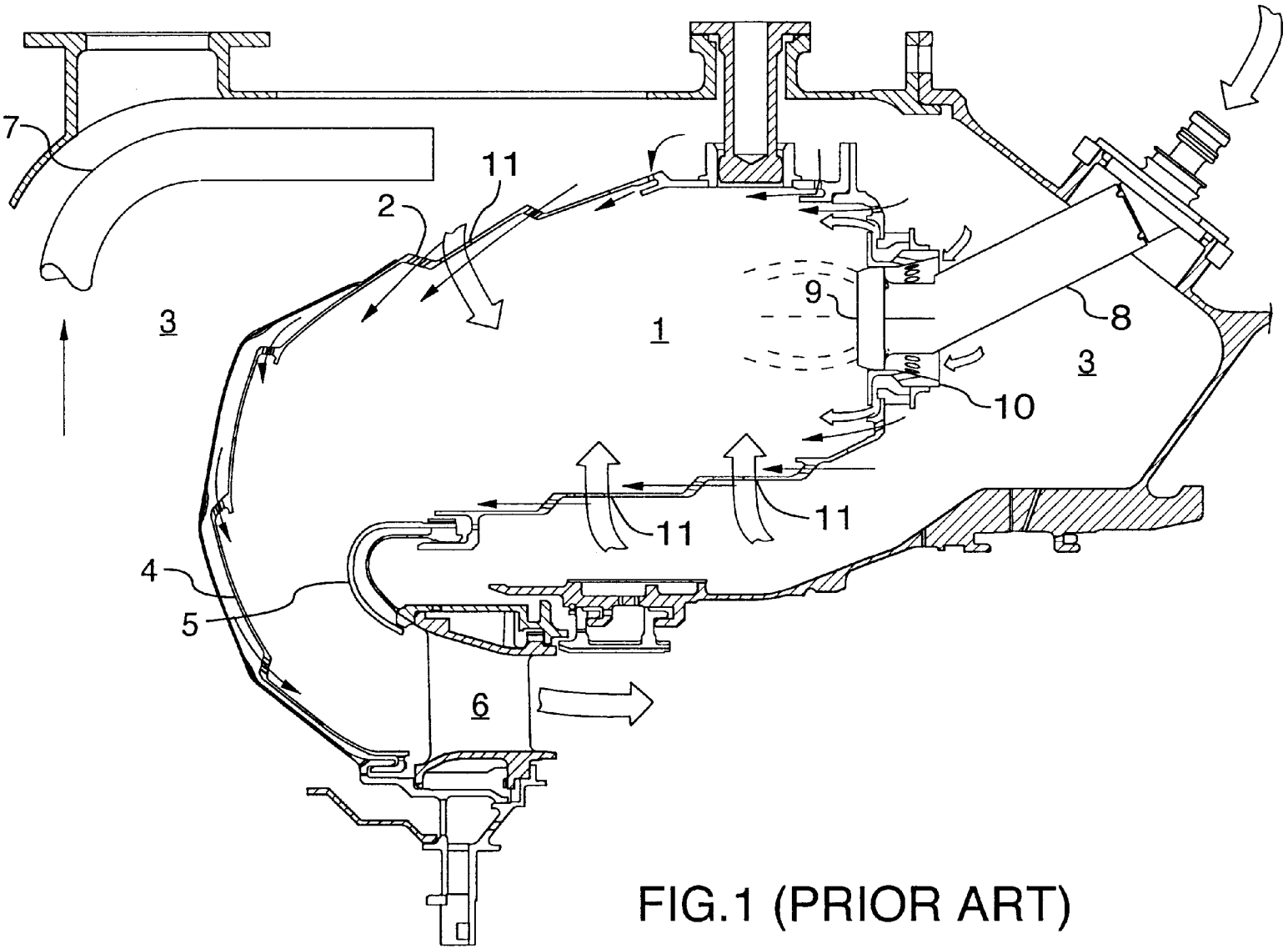
FIG.1 (PRIOR ART)
FIG. 1 is an axial sectional view through a conventional prior art reverse flow combustor for a gas turbine engine, in particular showing the complex arrangement of machined inner and outer combustor walls with openings, inlets and lips to form a curtain of cooling air between the hot combustion gases and the metal walls of the combustor.

The method according to the invention can enable gas turbine engine designers to construct a combustor having a geometry and temperature capability similar to existing metal combustors. However, the invention significantly reduces the quantity and weight of materials used since the method involves gradual building up of the metal foam and coating with exterior metal and interior ceramic. The built up foam with thin coatings produces a combustor that is much lighter than the conventional combustor shell that is machined from a forging of solid metal of tough expensive alloys.

The labour and design effort expended to form a combustor shell is reduced when a light weight foam metal is used. The foam can be readily moulded or shaped compared to conventional rigid metal shells that require at least a minimum thickness in order permit machining. The foam metal wall can be efficiently cooled with flow within the foam core and requires much a simpler arrangement of openings to create an internal film for cooling. By simply masking openings from the spray application of inner and outer coating on the metal foam, the invention provides a far simpler means of producing openings for cooling air compared with drilling numerous holes in a high precision machining operation in a thin shell of sheet metal.

Preferably, the outer wall and inner wall are constructed of two separate pieces. The middle foam core layer of each wall may be manufactured of a porous high temperature inter metallic foam material. The foam serves as a substrate upon which the outer metallic cladding layer and inner ceramic cladding layer are sprayed. With appropriate masking slots or openings are formed through which cooling air can effuse from the internal foam. A significant advantage of the foam structure is the ability to flex or conform to local stresses while maintaining air flow and pressure control with a substantially impervious outer metal skin and inner ceramic skin. As a result, the foam structure of the composite wall with inner and outer cladding layers is more compliant to thermal stresses and prevents any signficant stress build up from damaging the inner and outer layers.

Preferably the open cell metal foam material is nickel aluminide, a high temperate inter-metallic material. Nickel aluminide is relatively brittle at conventional atmospheric temperatures however it has a highly desirable strength and oxidation characteristics at the elevated temperatures experienced within a gas turbine engine combustor and is therefore superior to many conventional metallic materials for high temperature applications. The open cell structure of the metal foam core permits high velocity cooling air to flow through the porous core material under the pressure differential of the combustor. A high convective cooling rate can be achieved without the mixing of cooling air with the hot combustion gases within the combustor as in conventional film cooling methods. In conventional film cooling, numerous holes on the exterior surface of the combustor are used to create a film that protects the combustor metal walls from exposure to combustor gases but at the same time dilutes the combustor gases and lowers the combustion gas temperature. However, the foam metal material of the present core layer permits passage of cooling air inside the combustor wall and does not rely entirely on creation of an air film to protect and cool the combustor wall.

The foam core also has a large surface area that enhances heat transfer from the metal skin of the composite wall structure to the cooling air that passes through the porous core. Once the air passes out of the core into the combustor interior, a cooling air film can be generated thereby insulating the downstream surfaces from the hot combustor gases. A further advantage of passing cooling air through the porous core foam material is that the cooling flow can be bi-directional. The air passing through the foam core can be admitted downstream and passed through the porous core material in an upstream direction towards the burner. Once the airflow proceeds in the upstream direction within the porous core, the flow can then be turned while passing through outlets in the inner cladding layer to form an air film on the internal combustor surface and progress downstream to exit from the combustor. Bi-directional cooling flow is an extremely efficient form of cooling in comparison to the reliance on air film cooling in prior art sheet metal shell combustors. The diffusive flow of cooling air through the foam allows use of a relatively small number of metering holes through the outer metallic cladding layer or skin. Use of a composite wall with inner foam core ducting the cooling air flow uniformly through the wall thereby permits formation of a continuous circumferential film on the interior of the surface when cooling air diffuses into the combustor interior through openings or slots in the interior cladding layer. A significant advantage of this efficient cooling system is that the inner cladding layer can optionally be of a metallic material rather than brittle high temperature ceramic. A metallic inner cladding layer has a lower temperature resistance capacity but can rapidly conduct heat to the foam inner core. Therefore use of a foam core with internal flow of cooling air permits use of a metal liner inside the combustor to replace conventional ceramic liners. Ceramic layers are heavier than metal and also are prone to spalling in response to a strong temperature gradient due to the brittle nature and lack of flexibility of a ceramic skin in comparison to a metallic skin.

The invention also allows cooling air to protect exposed openings downstream of larger holes by maintaining a cooling film. In conventional combustors, the wake region of holes in a combustor wall suffer from the worst durability because of the difficulty in maintaining a cooling film in the wake regions. Cooling slots or openings can be easily created in the interior and exterior cladding layers of the composite wall simply by masking the regions before application of spray coating materials to avoid this problem.

The composite wall primarily consists of a porous metal foam core, which is inherently very light comprising 80% to 85% air voids. While the foam material by itself is not of high strength, the provision of continuous inner and outer cladding layers creates a classic sandwich effect increasing the section modulus of the wall. The separation of inner and outer cladding layers by the relatively light open foam core material significantly increases bending strength. A further advantage of the invention is that complex geometries are easily formed or moulded in the core substrate while the core is in a foam rubber state. Foam rubber is easily and quickly formed into complex geometries in contrast to the tough super metal alloys conventionally used. Once the basic geometry of the core substrate is formed, the rubber foam is converted thermally to a carbon structure which retains the porous foam characteristics, but is rigid enough to allow machining of intricate details that are not possible in the flexible rubber state. For example, holes can be accurately drilled, flanges, shoulders and other structural features can be added to the carbon foam structure by machining. The carbon core substrate serves as a supporting structure that is converted to nickel foam by metal vapour deposition. A thin layer of metal in a porous structure is deposited on the surfaces of the carbon foam thereby creating a metal foam supported on the carbon foam structure. In high heat the carbon burns off leaving behind the metal foam alone. The nickel foam is coated with aluminium also by metal deposition and is then converted to nickel aluminide by thermal reaction.

Prior art methods involve forging a sheet metal blank and then accurately machining the surface features and drilling openings to form features on the inner and outer combustor shell faces. This involves highly accurate removal of large amounts of expensive and difficult to machine materials. Expensive high quality materials are effectively wasted turning them into scrap metal of much lesser value in a labour intensive machining operation.

In contrast, the invention provides a technique for minimum use of raw materials that are added incrementally in small amounts during metal vapour deposition. In addition to avoiding creation of large amounts of wasted scrap material, the metal vapour deposition technique enables fine-tuning of the precise thickness of foam materials. For example, a longer period of time in a metal vapour deposition chamber will result in thicker layer of metal deposited on the carbon foam as will a variation of mould temperature. By varying the process of vapour deposition designers can increase or decrease the strength of the metal foam without changing the geometry significantly merely by increasing or decreasing the length of time during which the carbon foam is exposed to the metal vapour deposition environment.

The outer cladding layer or skin serves the purpose of sealing the outer surface of the foam core as a pressure vessel with air flow metering holes formed either by drilling or by masking during spray application of the outer cladding layer. Sealing of the outer cladding layer enables development of a controlled air pressure drop between the outside of the combustor and the internal combustor area in order to create a flow of cooling air through the porous middle metal foam core layer and then into the combustor through openings in the inner cladding layer. The second primary purpose of the outer cladding layer of skin is to increase the overall structural strength of the structure. A continuous outer cladding layer increases the structural strength of the composite layered wall and provides a thin high strength diaphragm on the relatively flexible open cell foam metal core. By spraying material on the outer surface of the metal foam core to form the outer cladding layers, the outer cladding layer can be built up in a very thin layer, such as 0.020 inches allowing for an extremely lightweight composite wall construction. Spray application permits accurate variations in the thickness of the outer cladding layer to accommodate stresses in different areas of the combustor. The thickness of the outer cladding layer can be easily varied to provide a thicker layer in areas of high stress for example. The outer cladding surface can be corrugated to provide for greater structural stiffness or cause variations in the cooling air flow direction without significant increase in weight or cost merely by shaping the outer surface of the metal foam substrate prior to spray application of the outer cladding layer material. Flow partitioning of various regions within the combustor can be easily controlled by metering holes that are drilled or formed by masking of the surface during spray application.

The inner cladding layer serves the purpose of sealing the inner surface of the foam core and separates the hot combustor gases within the combustor from the cooling air flow that passes between the inner and outer cladding layers within the foam core of the composite wall. The inner cladding layer is preferably applied in a spray process and includes cooling outlets for creation of cooling film simply by masking before spray application of the inner cladding materials. Use of a ceramic cladding layer can serve to reflect heat radiation energy back into the combustor. In conventional prior art combustors, a large part of a the cost of ceramic coating is due to the need to mask several portions of the internal surface to cover the large number of drilled openings. This invention however can produce a featureless internal design and makes coating application relatively simple and inexpensive. In conjunction with the outer cladding layer, the inner cladding layer also significantly strengthens the composite wall by increasing section modulus and providing a continuous internal diaphragm separated from the outer cladding layer by relatively light weight internal foam core. Due to the large section modulus of the composite wall, the composite wall has a relatively high strength to weight ratio compared to conventional uniform combustor designs.

Therefore, the composite wall of the invention results in superior cooling arrangements that are possible using air flow within the foam core layer, an inexpensive forming technique, efficient use of materials and high section modulus provides significant improvement over conventional combustor designs which use expensive machining techniques and create large amounts of wasted scrap material and labour intensive machining operations.

Further details of the invention and its advantages will be apparent from the detailed description included below.

DETAILED DESCRIPTION OF PREFERRED EMBODIMENTS

Figure 2:
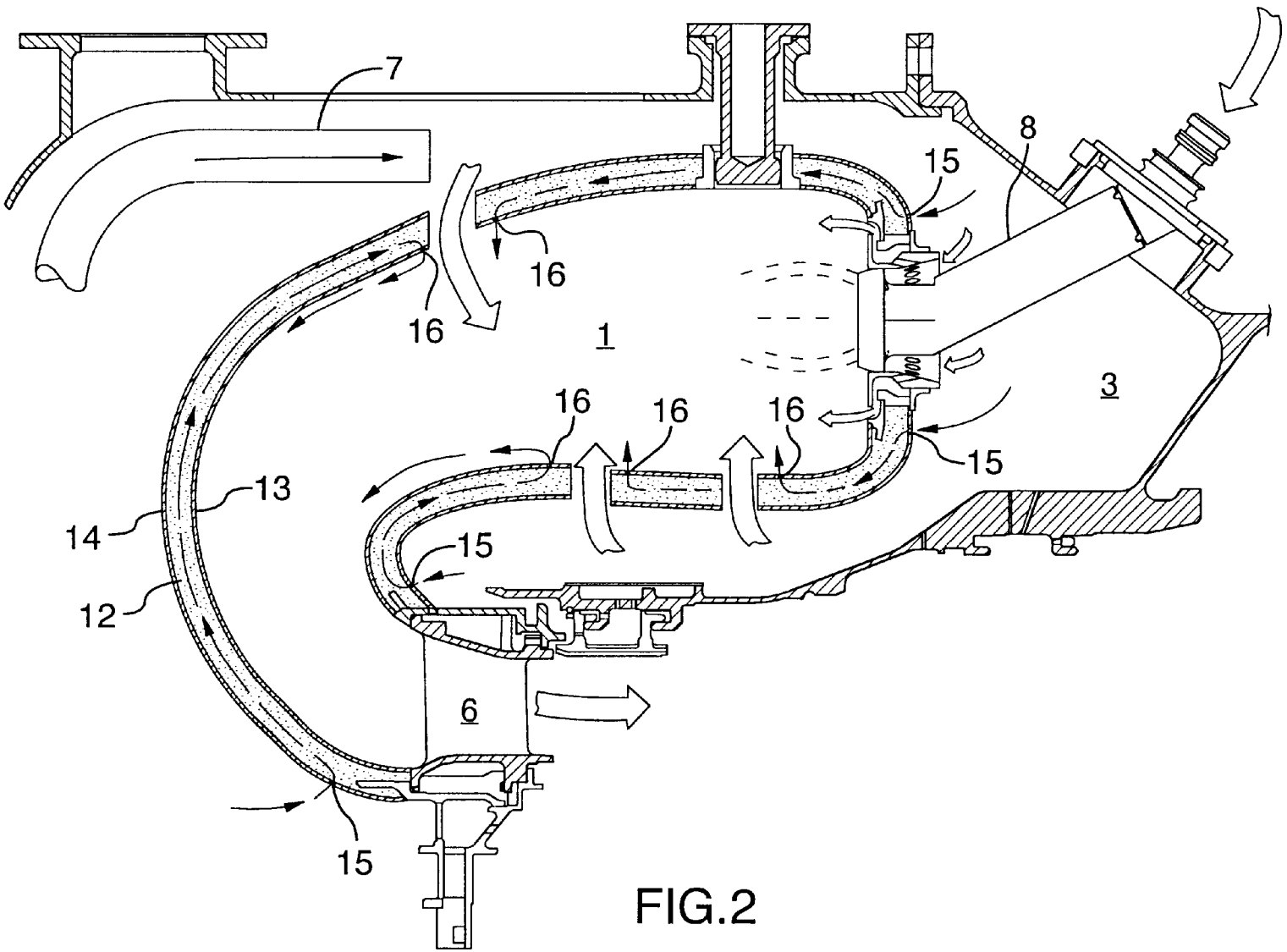
FIG. 2 is a like sectional view through a combustor manufactured in accordance with the present invention having an air permeable open cell metal foam core bounded by thin metal or ceramic walls inwardly and outwardly showing the flow of cooling air from the compressed air plenum about the combustor through outer openings, through the air permeable open cell metal foam core and exhausting into the interior of the combustor to form a cooling air film downstream of the fuel nozzle.

FIG. 1 illustrates a conventional prior art reverse flow arrangement whereas FIG. 2 shows an equivalent structure manufactured of a composite wall in accordance with the invention. In both cases the general combustor geometry is approximately the same and the supply of compressed air, fuel and ignition within the combustor is essentially the same. In addition, upstream and downstream portions of the engine are not significantly effected by the differences in combustor wall construction.

Referring to FIG. 1, the conventional combustor 1 is defined between an outer combustor wall 2 and an inner combustor wall 5. The walls 2 and 5, are annular shells that are manufactured from a forging of metal alloy and then reduced in thickness through machining that adds the surface features and shape details. Afterwards, in order to create openings for film airflow and for mixing air to enter the combustor, numerous small holes are drilled in the outer and inner walls 5 and 2. In the prior art combustor shown, the large exit duct 4 has a double wall layer to provide improved impingement cooling flow increasing durability of this section of the combustor. Cooled compressed air is fed from an impeller (not shown) through diffuser pipes 7 into a compressed air plenum 3 that completely surrounds the annular combustor 1. Liquid fuel under pressure is fed to the fuel nozzle 9 to fuel supply tube 8. As indicated in FIG. 1 with arrows, the compressed air housed within the plenum 3 is conveyed through openings in the nozzle cups 10. Openings within combustor walls 2 and 5 create a curtain of cooling air or an air film between the hot combustion gases and the metal surfaces of the combustor walls 2, 5. In addition, the plenum 3 provides compressed air to mix with the fuel that is sprayed from the fuel nozzle 9 to maintain the flame and to provide efficient combustion. Hot gases pass through the combustor 1 past the stator turbine state 6 to drive the turbine rotors in a known manner.

In the embodiment of the invention shown in FIG. 2, the combustor walls are replaced with a three layer composite wall that comprises an open cell metal foam core layer 12 bonded to an inner cladding layer 13 of ceramic or metal and an outer cladding layer 14, preferably of metal.

It will be understood that the method of invention can be used to create any shape of composite wall and is not limited to creating a combustor for a gas turbine engine. The composite wall structure can be utilized for many other engine components that can benefit from having a light-weight porous inner core, ease of forming and can be applied to the creation of structural members primarily depending on the economics involved.

The method of manufacturing the composite wall involves the following steps. A core substrate is created of open cell gas permeable foam in a selected geometry. In the embodiment the geometry comprises the approximate shape of one of the combustor and preferably is of open cell polyurethane rubber foam that is capable of thermal conversion to a carbon foam structure as noted above. Polyurethane foam rubber is easily moulded or shaped to the desired geometry and when subjected to high heat the polyurethane foam rubber will convert to a relatively brittle carbon foam structure that can be machined with integral details such as grooves, holes, slots or any other desired feature while maintaining the dimensions of the selected geometry. The foam could be also created in place in a combustor-shaped space.

The next step involves impregnating the open cell foam substrate with metal vapour and thereby depositing a porous layer of metal on the exposed internal and external surfaces of the open cell foam substrate. As a result, the carbon foam structure is coated with a thin layer of metal and forms an open cell metal foam core through metal vapour deposition.

The carbon foam structure when exposed to extreme heat in an oven will decompose. However in other applications, the designers may choose to leave the carbon foam structure intact to increase structural strength and to reduce manufacturing costs.

After completion of the above steps therefore, the open cell metal foam core layer 12 is masked internally and externally where openings and slots are desired. Through spray application of cladding materials such as metals or ceramics, the inner cladding 13 and the outer cladding layer 14 are deposited on the metal foam coat 12.

Preferably, the impregnating step creating the open cell metal foam core layer 12 involves exposing the carbon foam substrate to nickel vapour and therefore coating the carbon foam with a thin layer of nickel plating. Since pure nickel has relatively low high temperature resistance, nickel alloys can be formed by further coating the nickel metal foam core with aluminium through further metal vapour deposition. Afterwards, the nickel and aluminium layers can be reacted to form a nickel aluminide metal foam core by subjecting the assembly to high temperatures, for example.

The inner and outer cladding layers 12 and 13, are applied by spray coating in layers of thickness under 0.020 inches to produce a light weight composite sandwich wall with high strengths to weight ratio. THicker walls can be created in selected areas to increase strength if necessary. Masking of selected areas prior to spray application can form gas flow inlet ports 15 in communication with the gas permeable metal foam core 12 and gas flow outlet ports 16 in communication with the metal foam core 12. As shown in FIG. 2, the number of ports 15 and 16 disposed on the inner and outer cladding layers 13 and 14, direct cooling gas flow from the plenum 3 adjacent the outer layer 14, through an outer port 15, through the metal foam 12 between the inner and outer layers 13 and 14 and exits through the outlet port 16 formed within the inner layer 13.

It will be apparent that the inlet and outlet ports 15, 16 can be created by masking before spray application or alternatively may be drilled or machined in the completed surfaces 13 and 14 after spray application. The carbon core substrate may be machined to shape prior to vapour deposition or the metal foam core 13 may be machined after metal vapour deposition and before the spray application of inner and outer cladding layers 13 and 14.

Although the above description relates to a specific preferred embodiment as presently contemplated by the inventor, it will be understood that the invention in its broad aspect includes mechanical and functional equivalents of the elements described herein.

We claim:

1. A method of manufacturing a composite wall comprising an open cell metal foam core layer bonded to an inner cladding layer and an outer cladding layer, the method comprising the following steps:

creating a core substrate of open cell gas permeable foam in a selected geometry;

impregnating the open cell foam substrate with metal vapour and depositing a porous layer of metal on exposed internal and external surfaces of the substrate thereby forming the open cell metal foam core through metal vapour deposition; and forming the inner and outer cladding layers upon the metal foam core through spray application of cladding material selected from the group consisting of: metals; and ceramics.

2. A method of manufacturing a composite wall according to claim 1, wherein prior to the impregnating step, the core substrate is thermally converted to a carbon foam structure.

3. A method of manufacturing a composite wall according to claim 2, wherein the core substrate is created of an open cell polyurethane rubber foam capable of thermal conversion to the carbon foam structure.

4. A method of manufacturing a composite wall according to claim 1, wherein the impregnating step includes, exposing the substrate to nickel vapour and thereafter coating the nickel metal foam core with aluminium through metal vapour deposition.

5. A method of manufacturing a composite wall according to claim 4, wherein the impregnating step further includes reacting the nickel and aluminium to form a nickel aluminide metal foam core.

6. A method of manufacturing a composite wall for a gas turbine engine combustor according to any one of claims 1 to 5 wherein the step of forming of the inner and outer cladding layers includes masking at least one selected area of the metal foam core prior to spray application thereby forming a gas flow port in communication with the gas permeable metal foam core.

7. A method of manufacturing a composite wall according to claim 6 wherein a plurality of ports are disposed on the inner and outer layers to direct a cooling gas flow from the outer layer, through an outer port, through the metal foam between the inner and outer layers and exiting through the inner layer.

8. A method of manufacturing a composite wall according to claim 1 wherein the core substrate is machined prior to the impregnating step.

9. A method of manufacturing a composite wall according to claim 1 wherein the metal foam core is machined before the application of the inner and outer cladding layers.

10. A method of manufacturing a composite wall according to claim 1 wherein the inner and outer cladding layers are less than 0.020 inches in thickness.

* * * * *